United States Patent [19]

Kurematsu et al.

[11] Patent Number: 4,777,107

[45] Date of Patent: Oct. 11, 1988

[54] METHOD AND APPARATUS FOR IMAGE DEVELOPMENT USING A TWO COMPONENT DEVELOPER WITH CONTACT AND NON-CONTACT DEVELOPMENT STEPS ALTERNATED BY VIBRATION OF MAGNETIC PARTICLES SUBJECT TO ELECTRIC AND MAGNETIC FIELDS

[75] Inventors: Katsumi Kurematsu, Kawasaki; Yuji Sakemi, Yokohama, both of Japan

[73] Assignee: Canon Kabushiki Kaisha, Tokyo, Japan

[21] Appl. No.: 945,579

[22] Filed: Dec. 23, 1986

[30] Foreign Application Priority Data

Dec. 27, 1985 [JP] Japan ..... 60-292936
Jul. 15, 1986 [JP] Japan ..... 61-164572

[51] Int. Cl.[4] ..... G03G 9/14
[52] U.S. Cl. ..... 130/122; 118/658
[58] Field of Search ..... 118/658; 430/122

[56] References Cited

U.S. PATENT DOCUMENTS 4,653,427 3/1987 Hosaka et al. ..... 430/122
4,672,017 6/1987 Kamezaki ..... 430/122

*Primary Examiner*—John L. Goodrow

*Attorney, Agent, or Firm*—Fitzpatrick, Cella, Harper & Scinto

[57] ABSTRACT

A method of developing an electrostatic latent image using a developer including a mixture of electrically chargeable toner particles and high resistance magnetic carrier particles chargeable to a polarity opposite to that of the toner polarities, includes providing a developing zone where a developer carrying member for carrying the developer is opposed to an electrostatic latent image beaering member bearing the electrostatic latent image to be developed with a development clearance D, providing a layer of the developer on the developer carrying member, the developer layer having a thickness less than the clearance D, maintaining the magentic particles in the developer layer out of contact with the electrostatic latent image bearig member by magnetic field generating means disposed behind the developer carrying member, applying an external electric field in the developing zone wherein the electric field for vibrating the magnetic particles under influence of a magnetic field provided by the magnetic field generating means for intermittently contacting the magnetic particles to the latent image bearing member, and for reciprocating the toner particles in the developer layer between the latent image bearing member and the magnetic carrier particles in the developing zone to develop the electrostatic latent image.

20 Claims, 5 Drawing Sheets

METHOD AND APPARATUS FOR IMAGE DEVELOPMENT USING A TWO COMPONENT DEVELOPER WITH CONTACT AND NON-CONTACT DEVELOPMENT STEPS ALTERNATED BY VIBRATION OF MAGNETIC PARTICLES SUBJECT TO ELECTRIC AND MAGNETIC FIELDS

FIELD OF THE INVENTION AND RELATED ART

The present invention relates to a method and an apparatus for developing, using magnetic carrier particles and toner particles, an electrostatic latent image substantially formed by an electric field through electrophotography or a magnetic latent image forming technique.

A developing method is known wherein a two component developer comprising magnetic carrier and non-magnetic toner mainly consisting of resin, is used. In this method, the developer is carried on a surface of a developer carryig member in the form of a layer thereon. A magnetic field generating means is disposed behind the developer carrying member at a developing position, a magnetic brush is formed and directly contacted always to a surface of a latent image bearing member. This is a so-called two component contact developing method. This involves a problem of a trace of brushing being produced in the developed image or a problem that the toner is swept into a "heap". Those problems result from the magnetic brush physically contacting the latent image directly.

In order to eliminate those problems to provide an improved development, a propsal has been made in Japanese Laid-Open Patent Application No. 32061/1980 (Okubo) wherein an alternating electric field is used in the zone where the magnetic brush is formed, which has been put into practice in a commercial machine NP5500 of the assignee of this application. A similar method is disclosed in U.S. Pat. No. 4,496,644. In this method, however, the magnetic brush always brushes the surface of the latent image bearing member, with the result that the image density at the central portion of the image is not sufficient although the density at the marginal portion of the image is high, thus giving rise to another problem.

Another method has been proposed in U.S. Ser. No. 632,877 filed on July 20, 1984 (Japanese Laid-Open Patent Application No. 31152/1985, and Japanese Laid-Open Patent Application No. 31153/1985), U.S. Ser. No. 731,039 filed on May 6, 1985 (German DEOS 3506311) and U.S. Pat. No. 4557992, wherein the magnetic brush is not in contact with the latent image bearing member, and the developer mixture of the carrier and toner particles are always out of contact with the latent image bearing member. An alternating electric field is formed in a developing zone so that the toner particles jump to the latent image bearing member. Some of those publications disclose the magnetic carrier particles as well as the toner particles are reciprocated between the developer carrying member and the latent image bearing member (See U.S. Pat. Nos. 4,292,387; 4,395,476; 4,391,891; and 4,473,627 for the understanding of reciprocation) in the case where the magnetic particles are reciprocated, the magnetic particles can be deposited on the latent image bearing member. In order to prevent this, it is disclosed that the magnetic particles are bound on the developer carrying member by a magnetic field so that the developer particles are not finally deposited on the latent image bearing member. In those publications, however, the development is accomplished by the non-magnetic toner particles released from the surfaces of the magnetic particles, resulting in that the toner particles transferred onto the non-image area of the latent image bearing member cannot completely be removed so that a foggy background is produced. Therefore, the image density of the developed image cannot be increased.

A so-called jumping development wherein one component magnetic toner is used with application of alternating electric field, as disclosed in the above listed Patents for the understanding of the reciprocation. This method involves a problem that clear color development is difficult, since the toner is magnetic, and therefore, the toner particle has to contain magnetic material which is usually black in color.

U.S. Pat. Nos. 3,232,190; 3,893,418; 3,890,929; and 4,356,245 propose that the toner is transferred to the image area of the latent image bearing member, while it is not transferred in the non-image area, so as to solve the problem of the foggy background. In this method, however, the toner particles are transferred by the electric field produced by the latent image, and therefore, the image density is decreased when an attempt is made to prevent the foggy background; while the foggy background is produced when the image density is increased.

In order to make uniform the state of the surface of the developer layer to improve the development, a proposal has been made wherein the developing position is interposed between magnetic poles having opposite polarities in the above mentioned German DEOS 3506311 and U.S. Ser. No. 731,039, and a similar proposal has been made in U.S. Pat. No. 4,350,440 in which one component magnetic toner is used. However, the above described problems are not solved.

SUMMARY OF THE INVENTION

Accordingly, it is a principal object of the present invention to provide a method and an apparatus for development wherein the density difference between a central portion and marginal portion of an image is minimal, and the image density is uniform.

It is another object of the present invention to provide a method and an apparatus wherein a good image of high and uniform density is achieved.

It is a further object of the present invention to provide a method and an apparatus for development wherein a good image can be provided without foggy background.

It is a further object of the present invention to provide preferable conditions when the method or apparatus of the present invention is embodied.

According to an embodiment of the present invention, a layer of developer mixture containing toner particles and insulative magnetic carrier particles is kept from contacting a latent image bearing member by a magnetic field generating means, but an electric field is externally and intermittently applied so as to vibrate, expand or shift the developer mixture, and therefore, the developer layer is softly and intermittently contacted to the latent image bearing member, and the toner particles are reciprocated in the developing zone.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
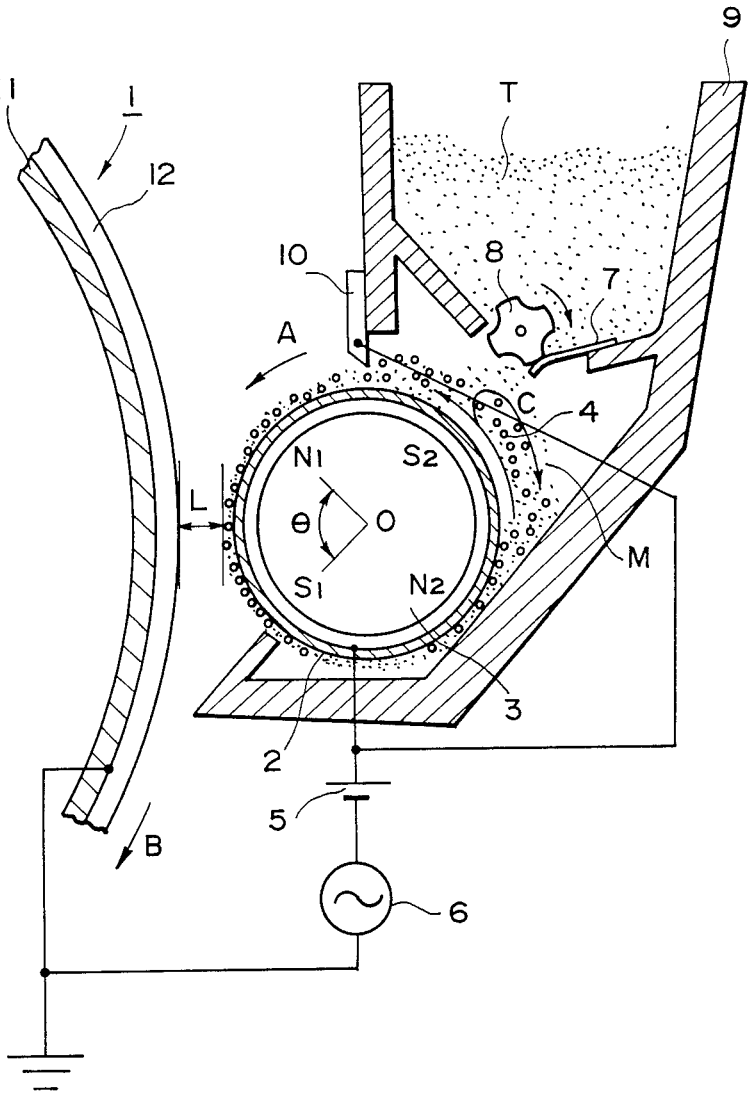
FIG. 1 is a sectional view of a developing apparatus according to an embodiment of the present invention.

Referring now to FIG. 1, there is shown a developing apparatus according to an embodiment of the present invention. Designated by a reference numeral 1 is a latent image bearing member for bearing an electrostatic latent image in this embodiment, and it comprises a back electrode 11 and a latent image bearing layer 12 formed thereon. The latent image bearing layer 12 may be of an insulating material or an electrophotographic photosensitive member. In FIG. 1, the latent image bearing member is illustrated as a photosensitive drum. The developing apparatus comprises a developer carrying member, which is of non-magnetic and conductive material in this embodiment, in the form of a sleeve rotatable in the dirction of an arrow A. The developer carrying member 2 is disposed with a clearance D between the photosensitive drum 1. The clearance is larger than a thickness of a developer layer formed on the sleeve 2, the developer layer having a thickness regulated by a doctor blade 10 which will be described hereinafter. The region adjacent the clearance constitutes a developing zone.

The sleeve 2 contains therein a magnet roller 3 which is concentric with the sleeve 2. The magnet roller 3 functions as a magnetic field generating means and is not rotatable. The magnet roller 3 has magnetic poles N1, S1, N2 and S2 (S indicates "S-pole", and N indicates "N-pole"). The magnet roller 3 is positioned such that the middle between the magnetic poles N1 and S1 (opposite polarities) is opposed to the photosensitive drum 1. More particularly, the center between the opposite magnetic poles is situated at the center of the developing zone.

Between the sleeve 2 and the back electrode 11 of the photosensitive drum 1 rotatable in the direction of an arrow B, a developing bias voltage is applied by a DC source 5 and an AC source 6, when the developing operation is performed.

Right above the sleeve 2, there is a doctor blade 10 functioning as a developer regulating means, having an end which is spaced from the surface of the sleeve 2 by a predetermined clearance.

The developer 4 comprises magnetic carrier particles M each containing resin material and magnetic material and non-magnetic toner particles T mainly consisting of resin and having an average particle size smaller than that of the magnetic carrier particles M. The toner is supplied from the upper container by a toner supplying roller 8 which is rotatable and effective to lightly beat a resilient member 7 by its rotation.

In operation, the sleeve 2 is rotated in the direction of the arrow A, so that the developer 4 is stirred in the direction of an arrow C, and simultaneously, the toner T is electrically charged by its friction with the magnetic particles M and the sleeve 2. The toner particles T are electrostatically attached to a sleeve 2 rotating in the direction of an arrow A or electrostatically attached to the magnetic particles, and therefore, the toner particles T, together with the magnetic particles M, are carried on the sleeve 2 in the direction of the arrow A as a developer mixture.

The developer mixture layer carried on the sleeve 2 reaches a position where the doctor blade 10 is disposed, where the magnetic force formed between the doctor blade 10 and the magnet roller 3 is effective to remove the excess developer mixture exceeding a predetermined thickness, so that a developer mixture layer having a uniform and predetermined thickness is formed and is carried to the developing zone.

Figure 2:
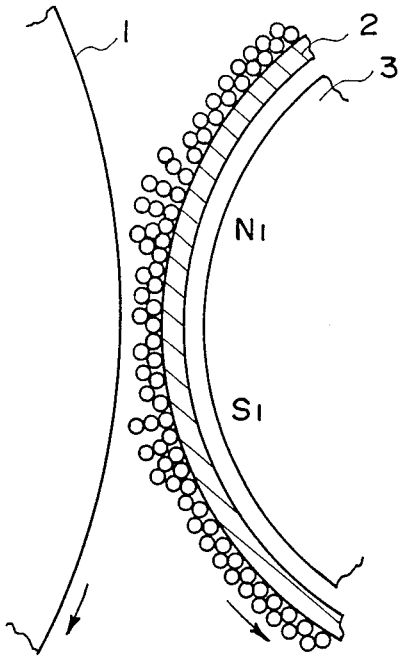
FIG. 2 illustrates the situation wherein no magnetic carrier particle vibrating electric field is applied, in the apparatus of FIG. 1.
Figure 3:
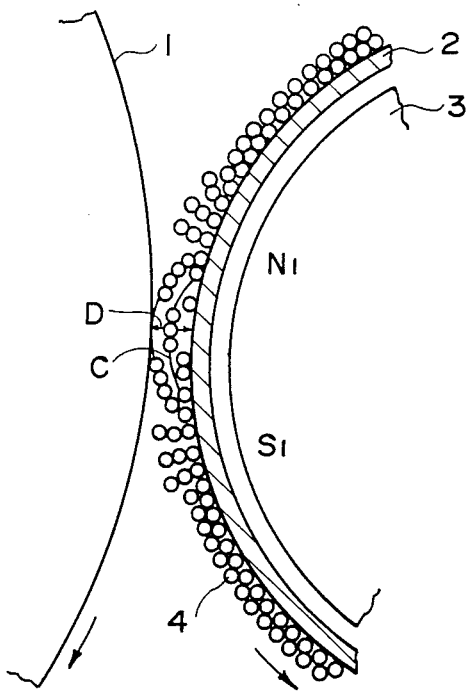
FIG. 3 is similar to FIG. 2, but with the vibrating electric field applied.

In the developing zone, the developer layer is bound by the binding force provided by the magnetic field, whereby the developer layer and the surface of the photosensitive drum 1 are kept from contact, as shown in FIG. 2 (when the developing operation is not performed, or when the electric field for vibrating the magnetic particles is not applied, which will be described hereinafter). Upon developing operation, an alternating electric field is formed in the developing zone by the application of a developing bias voltage, and then, a component of the electric field which is effective to move the magnetic particles M to the photosensitive drum 1 is intermittently produced. As shown in FIG. 3 by a reference character D, the magnetic particles M vibrate in the space between the drum 1 and the sleeve 2 so as to softly and intermittently contact the surface of the photosensitive drum 1, while the magnetic particles M are being bound by the magnetic lines of force C extending between the magnetic poles N1 and S1.

Simultaneously, the toner particles T are repeatedly transferred to and from the magnetic particles M and the surface of the photosensitive drum 1 (reciprocation) by the alternating electric field. The reciprocation only in the image area, the reciprocation only in the non-image area or the reciprocation in both of the image and non-image areas, are described in detail U.S. Pat. Nos. 4,292,387 and 4,395,476. Thus, at least in the developing zone, the toner particles T jump and reciprocate, whereby the image area is developed.

In the developing operation, the magnetic particles M are alternately subjected to contact period wherein the magnetic particles M are softly contacted to the surface of the photosensitive drum 1 and a non-contact period wherein the magnetic particles are not contacted with the surface of the drum. The developing action in the periods are considered as being as follows.

During the non-contact period, the binding force of the magnetic field is so strong that they are extended along the magnetic lines of force and are partly overlaid or closely contacted, whereby they are not forced to physically contact the surface of the photosensitive drum. Therefore, the magnetic particles M only release the charged toner particles on their surfaces when the forward component (directing the toner particles T toward the photosensitive drum 1) of the applied electric field provides a force larger than the force retaining the toner particles on the magnetic particles. In other words, during the non-contact period, the magnetic brush does not strongly hit the drum 1, and the surface of the magnetic particle layer which is uniformalized constitutes a base for the forward transfer movement of the toner particles, so as to stabilize the developing operation. Since the magnetic particles are not in contact with the surface of the drum 1, the toner particles T are uniformly applied to the surface of the drum 1.

During the contact period, on the other hand, the binding force by the magnetic field is weakened by the component of the magnetic particle vibrating electric field with the force by the electric field in the radial direction of the sleeve. Therefore, the magnetic lines of force are substantially displaced toward the drum 1. Therefore, the powder of the magnetic particles is moved toward the drum 1 so as to extend or shift along the displaced lines. Thus, the developer layer is expanded toward the drum 1 while being confined by the magnetic field. In this period, the magnetic particles are partly spaced, and a magnetic brush or developer layer which is soft as a whole is in formed and is contact with the surface of the drum 1. At this time, the magnetic particles are confined by the magnetic field, and therefore, they are not deposited on the surface of the drum 1 and are carried over. The charged toner particles deposited on the surfaces of the magnetic particles (including the charged toner particles T not supplied to the drum 1 by the forward component of the applied voltage) are applied to the drum 1 by physical contact therewith, so that the toner particles T are in contact with the entire image area including the central portion thereof, and are retained thereon by the potential of the image area. Simultaneously, the toner particles which may result in foggy background in the non-image area are removed from the drum 1 by the electric charge of the magnetic particles M. The toner particles are also removed from the drum 1 by a backward component (directing the toner particles T toward the sleeve 2) of an alternating electric field (including the magnetic particle vibrating field component in this embodiment), and therefore, fog prevention is much improved in combination with the above described system.

During the transit period from the contact period to the non-contact period, the developer layer is shifted from the loosened state to the non-contact state, and the toner particles within the developer layer ooze to the surface of the developer layer due to the difference in the diameter between the toner particles T and the magnetic particles M and due to a threshold for releasing the toner particles T from the magnetic particles by the magnetic particle vibration component and the forward component of the applied electric field. The toner particles, in the developing operation, are supplied from the uniform developer particle layer to the drum surface, whereby the density of the developed image can be uniformly increased. During the transtion period from the non-contact period to the contact period, the magnetic particles can catch the toner particles in the state of powder cloud produced by the toner reciprocation between the developer layer and the drum 1 during the non-contact state, by which the cloud toner is prevented from attaching to the non-image area of the drum.

In this embodiment, the developing zone is between the magnetic poles of opposite polarities, and therefore, the surface of the developer layer is uniform and smooth during the non-contact period, whereby the soft contact can be effected uniformly. Therefore, the developing operation is uniform, and the fog prevention is assured.

The voltage is applied externally. In this embodiment, the voltage is applied from the DC source 5 and the AC source 6 in combination. It is preferable that a bias voltage is used. It is possible that only an alternating voltage is applied as the bias voltage. The AC voltage is not necessarily in the form of a sine wave, but may be a pulse wave.

The principle of vibrating and contacting the developer particles while confining them by the magnetic lines C of force will be further described.

Figure 4:
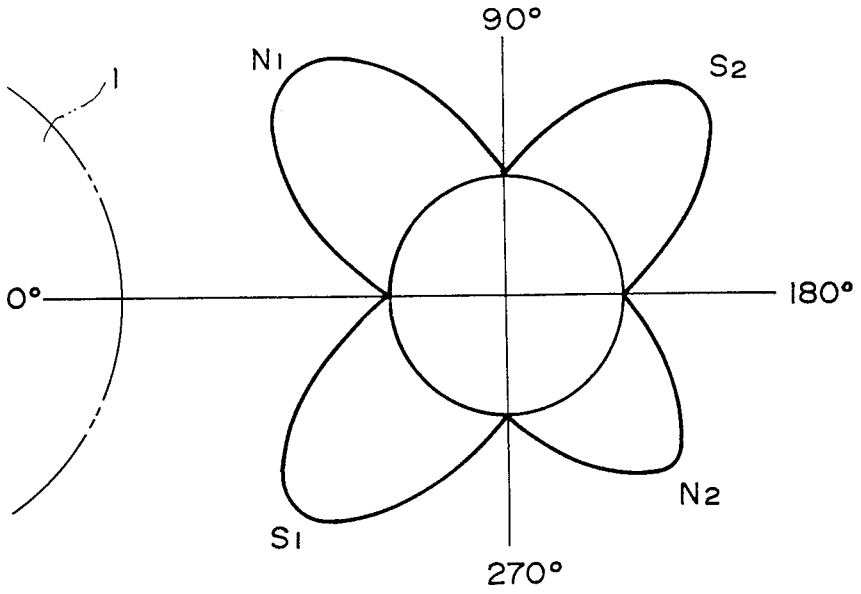
FIG. 4 illustrates distribution of the magnetic field in a radial direction provided by the magnetic field generating means, in the apparatus of FIG. 1.

FIG. 4 illustrates magnetic field distribution of the magnet roller 3. It is indicated with a radial (perpendicular to the sleeve surface) magnetic field component (strength of the magnetic pole) which is usually used to represent the strength of the magnetic field on the sleeve surface. In this Figure, the position is indicated by a horizontal reference line which is a line connecting the centers of the drum 1 and the sleeve 2 with the center of the developing zone being 0 degrees. The radial component is a component of the magnetic field in the direction perpendicular to the surface of the sleeve 2. FIG. 4 shows the distribution around the sleeve. As will be understood from this Figure, the magnetic field is 0 Gauss between the magnetic poles N1 and S1. However, in this invention, the magnetic particles are confined on the surface of the sleeve 2 even between the magnetic poles so that they are not transferred to the drum 1. This has been confirmed by experiments, although it is difficult to understand from the distribution of the magnetic field shown in FIG. 4.

Figure 5:
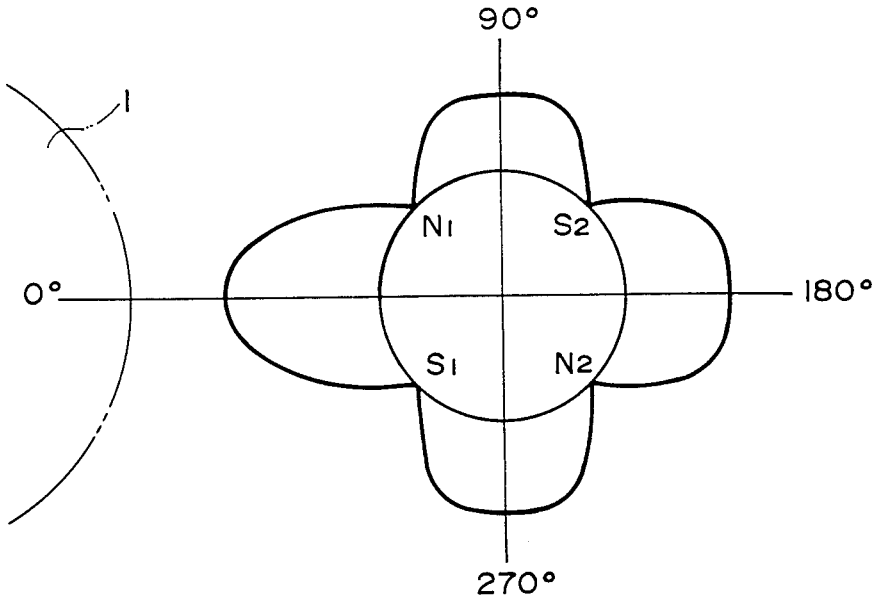
FIG. 5 illustrates a distribution of the magnetic field in a tangential direction formed by the magnetic field generating means, in the apparatus of FIG. 1.

This however, can be understood from FIG. 5, which indicates the distribution of the tangential component of the magnetic field on the sleeve surface. As will be understood, the magnetic lines of force are strong in the developing zone in the direction along the surface of the sleeve 2. The magnetic particles are confined on the surface of the sleeve 2 by this magnetic lines of force C along the sleeve surface. With this state, when the bias voltage is applied, the resulting alternating field, the developer particles start to vibrate while floating in the space adjacent to the sleeve surface as shown by an arrow D in FIG. 5. As a result, they are contacted to the surface of the drum 1.

Data of experiments which were performed, will be described.

EXPERIMENT 1

The development operation was performed under the following conditions:

Voltage of the latent image $V_D$: +700V

Background voltage $V_L$: 50V

Developing bias voltage: superposition of an AC voltage having peak-to-peak voltage 2800 Vpp and frequency f of 2.5 KHz and a DC voltage of +200V It is added that relatively good results were achieved when the peak-to-peak voltage was 1000–6000V, and the frequency f was 1–5 KHz.

The maximum tangential component of the magnetic field between the magnetic poles N1 and S1 in FIG. 5 was 600 Gausses. As a result of various and many experiments, it has been confirmed that a good image can be provided if the tangential magnetic field component is not less than 300 Gausses, preferably not less than 400 Gausses.

The non-magnetic particles used as a main component thermoplastic resin material (polystyrene) have an average particle size of approximately 6 microns. The non-magnetic particles are chargeable to a negative polarity with respect to the magnetic particles. If the toner chargeable to a positive polarity is used, and if the DC voltage is suitably set, a reversal development is possible. The magnetic particles contained, as a main component, styrene-acryl-aminoacryl copolymer resin and magnetic particles of magnetite ($Fe_3O_4$) of 70 wt % combined therewith, which thereafter was pulverized into an average particle size of 50 microns. It has been confirmed that when not more than 1 wt % of silica particles are used, which is between the two components of the developer mixture in the charge series, a good image can be provided.

What is important is that when the magnetic particle vibrating electric field component is not applied, the magnetic particles, of course, are not caused to jump from the developer layer on the sleeve 2 to the photosensitive drum 1. When the magnetic particles are carried over to the photosensitive drum, the amount of the magnetic particles in the developing apparatus decreases with use, with the result that the ratio between the number of the magnetic particles in the developer and the number of the non-magnetic particles (toner/magnetic particles) is significantly deviated. If this occurs, the foggy background results. For this reason, it is important to confine the magnetic particles on the surface of the sleeve by the magnetic force.

If the distance between the surface of the photosensitive drum 1 and that of the sleeve 2 is too large, the developer layer is not in contact with the drum surface, and therefore, edge effect or a thinned image results.

Therefore, the drum-sleeve clearance has to be determined in view of those considerations. In the experiments, the clearance was set to be 100–800 microns. It has been confirmed that 200–600 microns is preferable.

Under the conditions of the experiment, the chains of the developer particles do not stand on the sleeve in the developing zone. In addition, the developer layer can be vibrated in the space between the sleeve 2 and the drum 1 by the alternating electric field, and the developer layer can be softly contacted to the drum surface. Accordingly, the trace of brushing or a swept "heap" which is a drawback of conventional developing apparatus can be prevented. Additionally the edge effect, and a thinned image which are the drawbacks of non-contact development, can be eliminated, and a high quality developed image can be provided.

As for the magnetic particles in the experiment, insulative particles comprising styreneacryl-aminoacryl copolymer and the magnetite were used. Therefore, the vibration under the alternating electric field was produced by Coulomb force to the electric charge of the particles, so that the magnetic particles were not necessarily insulative, but conductive powder such as iron powder is usable. In the case where this is used, the conductive particles are vibrated under the alternating electric field due to the Coulomb force to the induced charge, and therefore, the similar development can be performed.

In the description of FIG. 1, the sleeve 2 is rotated in the direction of the arrow A, but it has been confirmed that a good image is provided if the sleeve 2 is rotated in the opposite direction. When the sleeve is rotated in the opposite direction, the density of the developed image is increased in a high speed development.

The relationship, concerned with the magnetic confinement of the magnetic particles, between the strength of the magnetic field component in the tangential direction on the sleeve surface between the opposite magnetic poles in the developing zone and the strength of the radial component of the magnetic field on the sleeve surface at the magnetic poles (N1, S1) is not always such that when the strengths of the radial component of the magnetic fields on the sleeve surface provided by the two magnetic poles are large, the strength of the tangential component of the magnetic field between the magnetic poles is large. When the two poles are spaced apart too much, the strength of the tangential component on the sleeve surface between the magnetic poles is decreased. When, on the contrary, the two poles are too close, the effective developing zone capable of providing proper development is made narrow, and in addition, the strength of the magnetic field component in the tangential direction cannot be increased. The experiments in consideration of those points, have showed that an angle $\theta$ seen from the central axis 0 of the magnet roller 3 which is also the rotational center of the sleeve 2 is preferably not less than 15 degrees and not more than 120 degrees between the magnetic poles Nl and Sl.

Various experiments have revealed that in order to stably obtain a high quality image, the average particle size $D_T$ of the non-magnetic particles (toner) and the number average particle size $D_C$ of the magnetic particles satisfy the following:

$$5D_T \leqq D_C \leqq 20D_T$$

If the particle size of the non-magnetic particles is too large as compared with the particle size of the magnetic particles, the triboelectric charge of the non-magnetic particles becomes insufficient. If it is too small, on the contrary, a poor image results.

EXPERIMENT 2

This experiment was carried out under the following conditions:

The clearance between the photosensitive drum surface and the sleeve surface: 500 microns Thickness of the developer layer: 300 microns at the position where it is closest to the photosensitive drum surface regulated by the doctor blade Developer: mixture of non-magnetic particles and magnetic particles Average particle size of the non-magnetic particles: 3 microns Non-magnetic particle content: 20% by weight Content of magnetic material in a magnetic particle: 65% by weight Average particle size of the magnetic particles: 50 microns The magnetic poles were arranged as shown in FIG. 1, namely, the drum is opposed to between the magnetic poles, the magnetic field in the radial direction of each of the magnetic poles N1 and S1 was 1200 Gauss. The magnetic field in the horizontal direction was 1040 Gausses.

Potential of the latent image $V_D$: −800V

Background potential $V_L$: −60V

Chargeability of the non-magnetic particles (toner): positive

Developing bias voltage: Superposition of an AC voltage having peak-to-peak voltage Vpp of 2800V and the frequency f of 4.0 KHZ and a DC voltage of −200V.

In the image area ($V_D$), only the non-magnetic particles were deposited, while no non-magnetic particles and no magnetic particles were deposited in the non-image area, and a good image was provided without foggy background.

EXPERIMENT 3

A reversal developing operation was performed wherein the low potential portion $V_L$ is developed under the same conditions as the Experiment 2 with the following exceptions:

Dark region potential of the latent image $V_D$: −700V

Light portion potential $V_L$: −80V

Chargeability of the non-magnetic particles: negative

Developing bias voltage: superposition of an AC voltage having the peak-to-peak potential of 2800 Vpp and the frequency of 3.0 KHz and a DC voltage of −550V In the light portion, the image area in this experiment, had only the non-magnetic particles, while no magnetic particles and no non-magnetic particles were deposited in the dark portion (non-image area in this experiment).

When the latent image potential was positive, positively chargeable non-magnetic particles were used with the DC voltage of +550V. The same results were obtained.

Figure 6:
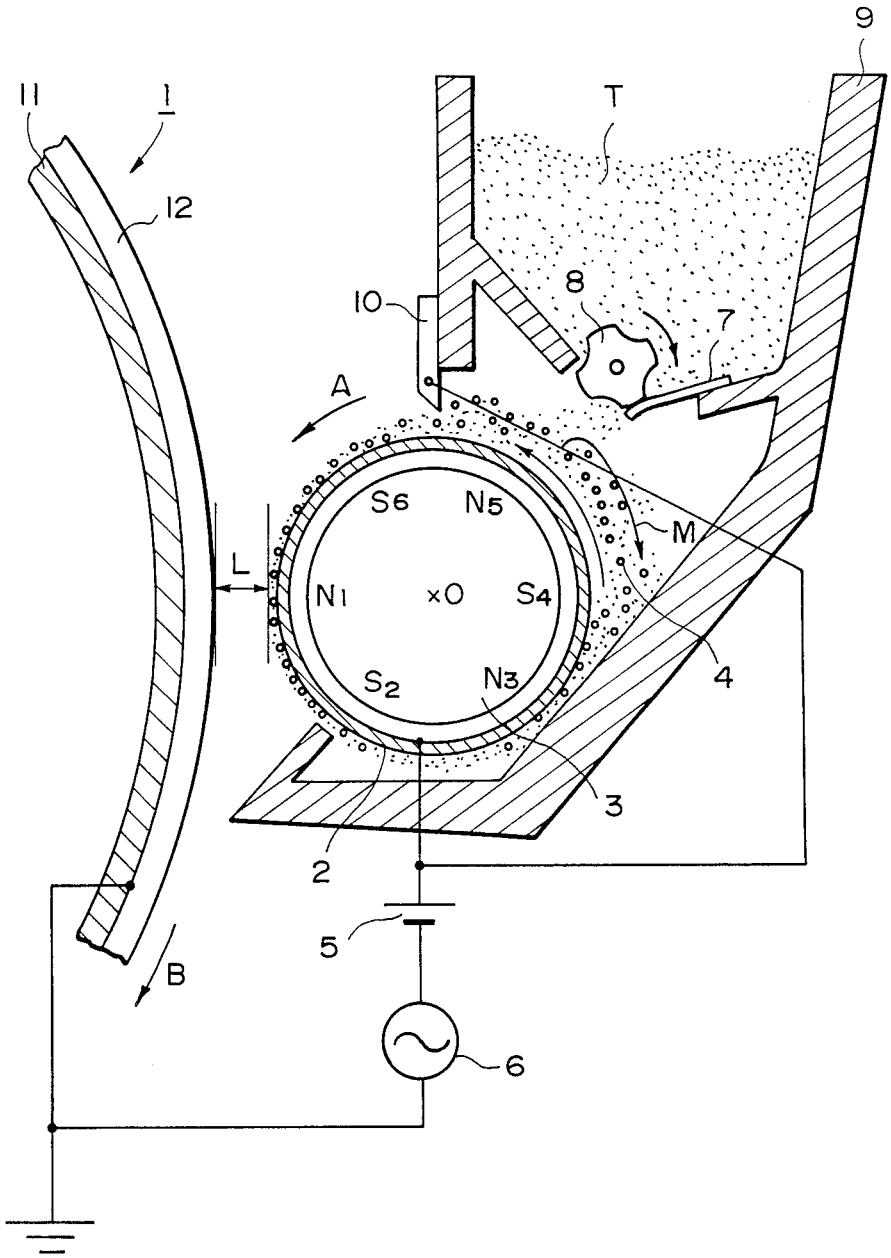
FIG. 6 is a sectional view of a developing apparatus according to another embodiment of the present invention.

FIG. 6 illustrates an apparatus according to another embodiment of the present invention. The chains of the magnetic particles forming the magnetic brush in the developing zone are standing on the sleeve, as contrasted to the case of FIG. 1 embodiment wherein the chains of the magnetic particles are lying along the sleeve surface. Only the points that are different from FIG. 1 embodiment will be described for the sake of simplicity.

The sleeve 2 contains a magnet roller 3 concentrically. The magnet roller has magnetic poles N1, S2, N3, S4, N5, S6. The magnet roller 3 is so positioned that the magnetic pole N1 is opposed to the photosensitive drum 1. In other words, the magnetic pole is at the center of the developing zone, as contrasted to the FIG. 1 embodiment.

Figure 7:
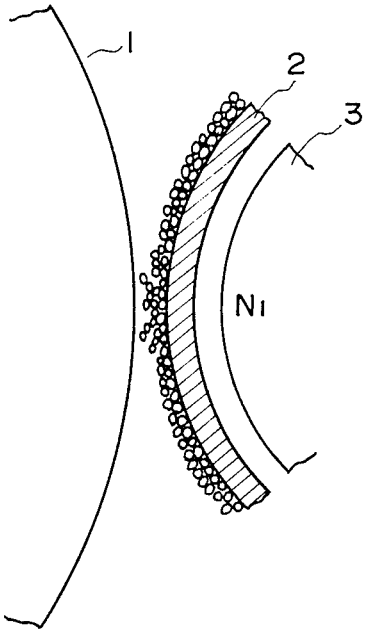
FIG. 7 illustrates a situation when no magnetic carrier particle vibrating electric field is applied in the apparatus of FIG. 6.
Figure 8:
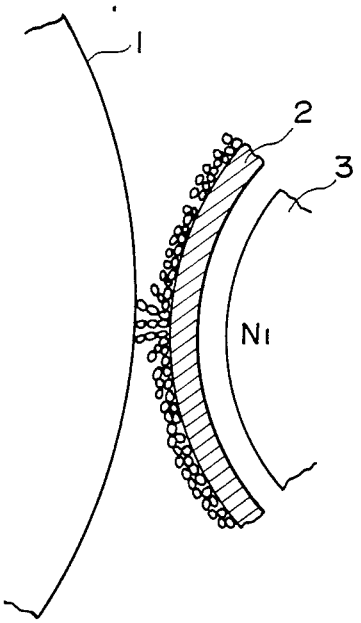
FIG. 8 illustrates a situation similar to FIG. 7, but with the vibrating electric field applied.

The developer layer in this developing zone is determined by the magnetic particles (carrier particles). When the developing operation is not performed or when the developer particle vibrating electric field component is not applied, as shown in FIG. 7, the developer layer containing the magnetic brush formed by the magnetic pole N1 are kept from contact with the surface of the drum. When the magnetic particle vibrating field component is applied in the developing operation, an alternating electric field is formed in the developing zone by the application of the developing bias, and therefore, as shown in FIG. 8, the developer layer in the developing zone expands or shift in the space between the sleeve and the drum and intermittently and softly contacts the drum surface, while being confined by the magnetic force provided by the magnetic pole N1. In this embodiment, it is not possible to provide a uniform surface condition of the entire developer layer, but the chains of the magnetic particles forming the magnetic brush are standing on the sleeve surface, and therefore, the surface of the magnetic particles in the base portion of the magnetic brush can be exposed to the photosensitive drum. By this, the toner particles in the base portion can be used for the development under the influence of the alternating electric field so that the development efficiency is increased.

The description of FIG. 1 embodiment applies to this embodiment generally. Further description of the principle will be made. In the developing zone, the magnetic lines of force are strong in the radial direction of the sleeve 2. The developer particles are bound on the sleeve surface by the radial magnetic lines of force. When the developing bias voltage is applied to produce the alternating electric field, the developer particles are more regularly arranged along the magnetic lines of force as shown in FIG. 8, with the result that the each of the chains of the developer particles expands to contact the surface of the drum to develop the latent image.

Data of experiments which were performed, will be described.

EXPERIMENT 4

The development operation was performed under the following conditions:

Voltage of the latent image $V_D$: +600V

Background voltage $V_L$: 50V

Developing bias voltage: superposition of an AC voltage having peak-to-peak voltage 3000 Vpp and frequency f of 400 Hz and a DC voltage of +200V It is added that relatively good results were achieved when the peak-to-peak voltage was 1000–4000V, and the frequency f was 100–5000 Hz.

The maximum tangential component of the magnetic field between the magnetic pole N1 in FIG. 6 was 600 Gausses. As a result of various and many experiments, it has been confirmed that a good image can be achieved if the tangential magnetic field component is not less than 200 Gausses, preferably not less than 300 Gausses.

The non-magnetic particles used as a main component thermoplastic resin material (polystyrene) having number average particle size of approximately 6 microns. The non-magnetic particles were chargeable to a negative polarity with respect to the magnetic particles. If the toner chargeable to a positive polarity is used, and if the DC voltage is suitably set, a reversal development is possible. The magnetic particles contained, as a main component, styrene-acryl-aminoacryl copolymer resin and magnetic particles of magnetite ($Fe_3O_4$) of 70 wt % combined therewith, which thereafter was pulverized into an average particle size of 50 microns. It has been confirmed that when not more than 3 wt % of silica particles is used, which is between the two components of the developer mixture in the charge series, a good image can be achieved.

What is important is that the magnetic particles are not caused to jump from the developer layer on the sleeve 2 to the photosensitive drum 1. When the magnetic particles are carried over to the photosensitive drum, the amount of the magnetic particles in the developing apparatus decreases with use, with the result that the ratio between the number of the magnetic particles in the developer and the number of the non-magnetic particles (toner/magnetic particles) is significantly deviated. If this occurs, the foggy background results. For this reason, it is important to confine the magnetic particles on the surface of the sleeve by the magnetic force.

If the distance between the surface of the photosensitive drum 1 and that of the sleeve 2 is too large, the developer layer is not contacted to the drum surface, and therefore, edge effect or a thinned image results.

Therefore, the drum-sleeve clearance has to be determined in view of those considerations. In the experiments, the clearance was set to be 100–900 microns. It has been confirmed that 200–700 microns is preferable.

Under the conditions of the experiment, the developer layer can be expanded in the space between the sleeve 2 and the drum 1 by the alternating electric field, and the developer layer can be softly contacted to the drum surface. Accordingly, the trace of brushing or a swept "heap" which is a drawback of conventional developing apparatus can be prevented. Additionally the edge effect, and a thinned image which are the drawbacks of non-contact development, can be eliminated, and a high quality developed image can be provided.

As for the magnetic particles in the experiment, insulative particles comprising styreneacryl-aminoacryl copolymer and the magnetite were used. Therefore, the vibration under the alternating electric field was produced by Coulomb force to the electric charge of the particles, so that the magnetic particles were not necessarily insulative, but conductive powder such as iron powder is usable. In the case where this is used, the conductive particles are vibrated under the alternating electric field due to the Coulomb force to the induced charge, and therefore, the similar development can be performed.

In the description of FIG. 6, the sleeve 2 is rotated in the direction of the arrow A, but it has been confirmed that a good image is provided if the sleeve 2 is rotated in the opposite direction. When the sleeve is rotated in the opposite direction, the density of the developed image is increased in a high speed development.

Various experiments have revealed that in order to stably obtain a high quality image, the average particle size $D_T$ of the non-magnetic particles (toner) and the average particle size $D_C$ of the magnetic particles satisfy the following:

$$5D_T \leqq D_C \leqq 20DT$$

If the particle size of the non-magnetic particles is too large as compared with the particle size of the magnetic particles, the triboelectric charge of the non-magnetic particles becomes insufficient. If it is too small, on the contrary, a poor image results.

EXPERIMENT 5

This experiment was carried out under the following conditions:

The clearance between the photosensitive drum surface and the sleeve surface: 300 microns Thickness of the developer layer: 250 microns at the position where it is closest to the photosensitive drum surface regulated by the doctor blade Developer: mixture of non-magnetic particles and magnetic particles Average particle size of the non-magnetic particles: 3 microns Non-magnetic particle content: 10% by weight Content of magnetic material in a magnetic particle: 70% by weight Average particle size of the magnetic particles: 55 microns The magnetic poles were arranged as shown in FIG. 6, namely, the drum is opposed to the magnetic pole N1, the magnetic field in the radial direction the magnetic pole N1 was 1100 Gauss.

Potential of the latent image $V_D$: −600V

Background potential $V_L$: −60V

Chargeability of the non-magnetic particles (toner): positive

Developing bias voltage: Superposition of an AC voltage having peak-to-peak voltage Vpp of 2000V and the frequency f of 4.0 KHZ and a DC voltage of −200V.

In the image area ($V_D$), only the non-magnetic particles were deposited, while no non-magnetic particles and no magnetic particles were deposited in the non-image area, and a good image was provided without foggy background.

EXPERIMENT 6

A reversal developing operation was performed wherein the low potential portion $V_L$ is developed under the same conditions as the Experiment 2 with the following exceptions:

Dark region potential of the latent image $V_D$: −600V

Light portion potential $V_L$: −80V

Chargeability of the non-magnetic particles: negative

Developing bias voltage: superposition of an AC voltage having the peak-to-peak potential of 2000 Vpp and the frequency of 4.0 KHz and a DC voltage of −450V In the light portion, the image area in this experiment, had only the non-magnetic particles, while no magnetic particles and no non-magnetic particles were deposited in the dark portion (non-image area in this experiment).

When the latent image potential was positive, positively chargeable non-magnetic particles were used with the DC voltage of +450V. The same results were obtained.

As described in the foregoing, according to the present invention, a position of the magnetic field generating member between its magnetic poles or a position of its magnetic pole is disposed in the developing zone, whereby the developer particles are bound along the magnetic lines of force; a component of electric field effective to vibrate the magnetic carrier particles of the developer particles is applied to the magnetic particles so as to vibrate the magnetic particles, thus intermittently contacting them to the latent image bearing member surface. By this developing method or apparatus, the resultant image is without edge effect (good solid black image), without thinning of image, without a trace of brushing and without a swept "heap", and therefore, a sharp and faithful image of high quality can be provided.

The inventors have further found preferable other conditions through various experiments and considerations. Those conditions which will be described in the following paragraphs are preferable individually or in combination, and are peculiar to the developing method or apparatus according to the present invention.

The insulative and magnetic carrier particles preferably have diameters larger than those of the toner particles, and preferably have an average particle size not less than 50 microns, since then sufficient electric charge can be given to the toner particles, and the mass of the carrier particles is effective to prevent themselves from being deposited onto the surface of the drum in combination with the prevention by the magnetic field. However, the particle size of the carrier particles is preferably not more than 100 microns in the average in order to maintain the stabilized development efficiency.

The clearance L between the surface of the drum and the surface of the developer mixture layer is preferably not more than 100 microns from the standpoint of preferable degree of vibration and expansion of the magnetic powder, since otherwise the particle size of the magnetic particles is required to be increased, and therefore, the development efficiency has to be decreased in some cases. Further, the clearance L is preferably not more than 50 microns, since then the vibration of the magnetic particles and the degree of the soft contact to the drum surface by the expansion of the magnetic particles are enhanced so as to further prevent the foggy background production. The clearance L is preferably equal to or not more than the average particle size of the magnetic carrier particles. In view of this, it is preferable that the clearance L is not more than 50 microns, and the particle size of the carrier particles is not less than 50 microns, with the best quality image.

The alternating electric field applied to the minimum clearance D (microns) between the sleeve and the drum includes a component for vibrating the magnetic carrier particles, and the peak-to-peak voltage Vpp (KV) which is the difference between the maximum potential and the minimum potential satisfies the following:

$$(20/3)D \geqq Vpp \geqq 5D$$

More particularly, when the clearance is 300 microns, 1.5 KV of the alternating electric field is preferable.

Insulation of the carrier particles is preferably not less than $10^6$ ohm-cm, when measured with respect to a predetermined amount of carrier particles sandwiched between measuring electrodes without pressure under the application of 10,000 V/cm electric field, since otherwise the carrier particles can act as conductive particles with the result that current leak can occur under the application of the alternating electric field during continuous long time use. Further, the insulation is preferably such that the resistance is not more than $10^{14}$ ohm-cm under the same measurement manner, since otherwise the electric charge of the carrier particles themselves are too much increased, with the result that they can be deposited onto the drum surface during long continuous use or that the toner particles are strongly retained on the surface of the carrier particles, and therefore, the toner particles are not sufficiently charged electrically.

The charge of the carrier particles is preferably not less than 0.5 micro-Coulomb/g and not more than 5 micro-Coulomb/g (during development), when it is measured through blow-off method, and the toner particles and carrier particles are completely separated, and then the charge of the carrier particles is obtained. This charging property is concerned with the prevention of foggy background caused by the magnetic particles and with the prevention of the carrier particles from attaching to the surface of the drum. If this is less than 0.5 micro-Coulomb/g, the fog prevention effect is not satisfactory; if it exceeds 5 micro-Coulomb/g, the carrier particles strongly retain the toner particles, and they tend to attach to the surface of the drum.

The magnetic properties of the magnetic particles are important from the standpoint of effective magnetic field binding. Among those properties, not less than 30 emu/g and not more than 100 emu/g are preferable under the condition of measurement of 10 KÖe (10,000 Gauss). If it is less than 30 emu/g, the magnetic binding force is not sufficient so that the loss of the magnetic carrier particles is increased; and if it exceeds 100 emu/g, the degree of expansion of the magnetic brush decreases with the result of decreased fog prevention effect and the development operation. This requirement of the magnetic property is effective to stabilize the expansion of the magnetic particles and other advantages of the present invention.

The present invention is not limited to the embodiments, and includes any combinations of them.

While the invention has been described with reference to the structures disclosed herein, it is not confined to the details set forth and this application is intended to cover such modifications or changes as may come within the purposes of the improvements or the scope of the following claims.

What is claimed is:

1. A method of developing an electrostatic latent image using a developer including a mixture of electrically chargeable toner particles and high resistance magnetic carrier particles chargeable to a polarity opposite to that of the toner particles, comprising:

providing a developing zone where a developer carrying member for carrying the developer is opposed to an electrostatic latent image bearing member bearing the electrostatic latent image to be developed with a development clearance D;

providing a layer of the developer on the developer carrying member, the developer layer having a thickness less than the clearance D in the developing zone;

maintaining the magnetic particles in the developer layer out of contact with the electrostatic latent image bearing member in the developing zone by magnetic field generating means disposed behind the developer carrying member; and applying an external electric field in the developing zone wherein the electric field vibrates the magnetic particles under influence of a magnetic field provided by the magnetic field generating means for intermittently contacting the magnetic particles with the latent image bearing member, and for reciprocating the toner particles in the developer layer between the latent image bearing member and the magnetic carrier particles in the developing zone to develop the electrostatic latent image.

2. A method according to claim 1, wherein an average particle size $D_T$ of the toner particles is not more than 6 microns, and the particle size $D_T$ and an average particle size $D_C$ of the magnetic carrier particles satisfy, $$5D_T \leqq D_C \leqq 20D_T.$$

3. A method according to claim 2, wherein the particle size $D_C$ is not less than 50 microns, and the magnetic carrier particles are insulative.

4. A method according to claim 1, wherein a clearance between the latent image bearing member and a surface of the developer layer under influence of the magnetic field generating means is not more than 100 microns.

5. A method according to claim 4, wherein the clearance is not more than 50 microns when the average particle size of the magnetic carrier particles is not less than 50 microns.

6. A method according to claim 1, wherein a resistance of the magnetic carrier particles is not less than $10^6$ ohm-cm and not more than $10^{14}$ ohm-cm, when it is measured between electrodes without pressure in an electric field of 10,000 V/cm.

7. A method according to claim 1, wherein electric charge of the magnetic carrier particles is not less than 0.5 micro-Coulomb/g and not more than 5 micro-Coulomb/g.

8. A method according to claim 1, wherein a magnetic property of the magnetic carrier particles is not less than 30 emu/g and not more than 100 emu/g in a magnetic field of 10,000 Gausses.

9. A method according to claim 6, wherein a magnetic property of the magnetic carrier particles is not less than 30 emu/g and not more than 100 emu/g in a magnetic field of 10,000 Gausses, and the average particle size is not less than 50 microns.

10. A method according to claim 1, wherein said electric field includes a component of an alternating electric field for intermittently contacting the magnetic particles with the latent image bearing member, having a difference Vpp (KV) between a maximum potential and a minimum potential which satisfies, $$(20/3)D \geqq Vpp \geqq 5D.$$

11. A method according to claim 1, wherein said magnetic field generating means includes one magnetic field generating portion which is opposed to the developing zone to constitute chains of the developer standing from the developer carrying member, in the developing zone.

12. A method according to claim 1, wherein said magnetic field generating means forms a magnetic field extending sustantially along a surface of the developer carrying member in the developing zone by its two magnetic field generating portions of opposite magnetic polarities, whereby the developer extends substantially in a direction of movement of the developer carrying member.

13. An apparatus for developing an electrostatic latent image on a latent image bearing member using a developer including a mixture of electrically chargeable toner particles and high resistance magnetic carrier particles chargeable to a polarity opposite to that of the toner particles, comprising:

a developer carrying member for opposing the latent image bearing member with a developing clearance D to form a developing zone therebetween, and for conveying the developer thereon into the developing zone;

a stationary magnetic field generating means disposed behind said developer carrying member, said magnetic field generating means having magnetic poles of opposite magnetic polarities between which it is opposed to the developing zone to form magnetic lines of force substantially along a surface of said developer carrying member to maintain the developer thereon out of contact with the latent image bearing member; and electric field applying means for applying an electric field for vibrating the magnetic carrier particles under influence of the magnetic field provided by said magnetic field generating means so as to contact the magnetic carrier particles with the latent image bearing member, and for reciprocating the toner particles between the magnetic carrier particles and the latent image bearing member.

14. An apparatus according to claim 13, wherein said developer carrying member includes a sleeve of non-magnetic material, and an angle about a rotational axis of the sleeve and formed between maximum magnetic field generating parts of said magnetic field generating portions is not less than 15 degrees and not more than 120 degrees.

15. An apparatus according to claim 13, wherein said magnetic field generating means is effective to maintain not more than 100 microns of a clearance between a surface of the developer layer and the latent image bearing member when said electric field applying means is inoperative.

16. An apparatus according to claim 15, wherein said magnetic carrier particles have an average particle size not less than 50 microns, and wherein said magnetic field generating means maintains not more than 50 microns of the clearance between the surface of the developer layer and the latent image bearing member when said electric field applying means is inoperative.

17. An apparatus for developing an electrostatic latent image on a latent image bearing member using a developer including a mixture of electrically chargeable toner particles and high resistance magnetic carrier particles chargeable to a polarity opposite to that of the toner particles, comprising:

a developer carrying member for opposing the latent image bearing member with a developing clearance D to form a developing zone therebetween, and for conveying the developer thereon into the developing zone;

a stationary magnetic field generating means disposed behind said developer carrying member, said magnetic field generating means forming a magnetic brush opposed to the latent image bearing member and maintaining it out of contact with the latent image bearing member; and electric field applying means for applying an electric field for vibrating the magnetic carrier particles under influence of the magnetic field provided by said magnetic field generating means so as to contact the magnetic carrier particles with the latent image bearing member, and for reciprocating the toner particles between the magnetic carrier particles and the latent image bearing member.

18. An apparatus according to claim 17, wherein said magnetic field generating means is effective to maintain not more than 100 microns of a clearance between a surface of the developer layer and the latent image bearing member when said electric field applying means is inoperative.

19. An apparatus according to claim 18, wherein said magnetic carrier particles have an average particle size not less than 50 microns, and wherein said magnetic field generating means maintains not more than 50 microns of the clearance between the surface of the developer layer and the latent image bearing member when said electric field applying means is inoperative.

20. A method of developing an electrostatic latent image using a developer including a mixture of electrically chargeable toner particles and high resistance magnetic carrier particles chargeable to a polarity opposite to that of the toner particles comprising:

providing a developing zone where a developer carrying member for carrying the developer is opposed to an electrostatic latent image bearing member bearing the electrostatic latent image to be developed with a development clearance D;

providing a layer of the developer on the developer carrying member, the developer layer having a thickness less than the clearance D in the developing zone;

maintaining the magnetic particles in the developer layer out of contact with the electrostatic latent image bearing member in the developing zone by magnetic field generating means disposed behind the developer carrying member; and applying an external electric field in the developing zone wherein the electric field vibrates the magnetic particles under influence of a magnetic field provided by the magnetic field generating means for intermittently contacting the magnetic particles with the latent image bearing member, and for reciprocating the toner particles in the developer layer between the latent image bearing member and the magnetic carrier particles in the developing zone to develop the electrostatic latent image;

wherein a clearance between the latent image bearing member and a surface of the developer layer under influence of the magnetic field generating means is not more than 100 microns; wherein a resistance of the magnetic carrier particles is not less than $10^6$ ohm-cm and not more than $10^{14}$ ohm-cm, when it is measured between electrodes without pressure in an electric field of 10,000 V/cm; and wherein a magnetic property of the magnetic carrier particles is not less than 30 emu/g and not more than 100 emu/g in a magnetic field of 10,000 Gausses.

* * * * *

UNITED STATES PATENT AND TRADEMARK OFFICE

CERTIFICATE OF CORRECTION

PATENT NO. : 4,777,107

DATED : October 11, 1988

INVENTOR(S) : KATSUMI KUREMATSU ET AL.

It is certified that error appears in the above-identified patent and that said Letters Patent is hereby corrected as shown below:

AT [57] ABSTRACT

Line 5, "polarities," should read --particles,--.
Line 8, "beaering" should read --bearing--.
Line 13, "magentic" should read --magnetic--.
Line 14, "bearig" should read --bearing--.

COLUMN 1

Line 22, "carryig" should read --carrying--.
Line 34, "propsal" should read --proposal--.
Line 55, "are" should read --is--.

COLUMN 2

Line 13, "as" should read --is--.

COLUMN 3

Line 43, "dirction" should read --direction--.

COLUMN 4

Line 56, "detail" should read --detail in--.

COLUMN 5

Line 12, "uniformalized" should read --uniformized--.
Line 31, "in formed and is" should read --formed and is in--.

UNITED STATES PATENT AND TRADEMARK OFFICE

CERTIFICATE OF CORRECTION

PATENT NO. : 4,777,107

DATED : October 11, 1988

INVENTOR(S) : KATSUMI KUREMATSU ET AL.

It is certified that error appears in the above-identified patent and that said Letters Patent is hereby corrected as shown below:

COLUMN 9

Line 61, "are" should read --is--.
Line 67, "shift" should read --shifts--.

COLUMN 10

Line 48, "number" should read --an--.

COLUMN 11

Line 20, "Additionally" should read --Additionally,--.
Line 49, "$5D_T \leqq D_C \leqq 20DT$" should read --$5D_T \leqq D_C \leqq 20D_T$--.

COLUMN 12

Line 34, "frequency of" should read --frequency f of--.

COLUMN 15

Line 38, "sustantially" should read --substantially--.

UNITED STATES PATENT AND TRADEMARK OFFICE

CERTIFICATE OF CORRECTION

PATENT NO. : 4,777,107

DATED : October 11, 1988

INVENTOR(S) : KATSUMI KUREMATSU ET AL. Page 3 of 3

It is certified that error appears in the above-identified patent and that said Letters Patent is hereby corrected as shown below:

COLUMN 16

Line 68, "particles" should read --particles,--.

Signed and Sealed this

Eighth Day of May, 1990

*Attest:*

HARRY F. MANBECK, JR.

*Attesting Officer*

*Commissioner of Patents and Trademarks*